United States Patent [19]

Guichon

[11] Patent Number: 4,749,232

[45] Date of Patent: Jun. 7, 1988

[54] STACKABLE CHAIR WITH FOLDABLE BACK REST OF ADJUSTABLE INCLINATION

[75] Inventor: Jean-Paul Guichon, Saint Lupicin, France

[73] Assignee: Grosfillex, Oyonnax, France

[21] Appl. No.: 3,089

[22] Filed: Jan. 14, 1987

[30] Foreign Application Priority Data

Jan. 30, 1986 [FR] France ..... 86 01315

[51] Int. Cl.[4] ..... A47C 3/04; A47C 1/00

[52] U.S. Cl. ..... 297/359; 297/239; 297/378; 297/379

[58] Field of Search ..... 297/381, 378, 379, 359, 297/239

[56] References Cited

U.S. PATENT DOCUMENTS 2,776,704 1/1957 Moore et al. ..... 297/27
3,758,155 9/1973 Straits ..... 297/239 X

FOREIGN PATENT DOCUMENTS 2237641 2/1974 Fed. Rep. of Germany .
834671 11/1938 France ..... 297/239
2372609 6/1978 France .
326491 3/1935 Italy ..... 297/28

OTHER PUBLICATIONS

Fr Search Report dated Sep. 23, 1986.

*Primary Examiner*—James T. McCall
*Attorney, Agent, or Firm*—Ladas & Parry

[57] ABSTRACT

A chair has a seating surface supported by two, laterally-spaced leg members extending above the seating surface to receive arm rests, a back rest mounted for pivoting at its base on a back end of said seating surface, and the arm rests mounted for pivoting on the back rest. Leg pairs of each leg member converge upwardly and are rigidly joined by a head brace, so as to be stackable. Arm rests, which respectively rest on the head braces, are dismountably secured thereto. A rear end of each arm rest is joined to the back rest via a pivot pin situated above the level of the arm rest when on the head brace, at such a distance from a pivot pin mounting the back rest to the seating surface that the rear end of said arm rest can move beyond the opposite front end of the brace, when the back rest is folded down on, i.e. pivoted to, the seating surface.

11 Claims, 2 Drawing Sheets

STACKABLE CHAIR WITH FOLDABLE BACK REST OF ADJUSTABLE INCLINATION

The present invention relates to an indoor or outdoor chair having a seating surface supported by two, laterally spaced of leg members which extend above the seating surface to receive arm rests, a back rest mounted for pivoting at its base on a back end of said seating surface, and the arm rests mounted for pivoting on the back rest.

The object of the present invention is to allow the back rest of the chair to pivot forward so as to cover the seating surface, and thus to make the chair stackable. Concomitantly, to simplify and speed up the operation, the arm rests follow the back rests when this is folded down, without having to dismantle any of the parts, which could give rise to losses.

Another object of the invention is to give the possibility to adjust the inclination of the back rest, without interfering with the main object indicated hereinabove.

The final object of the invention is to produce the chair in plastic material, with a very small number of components, hence of molds, and to be able to readily mount it, without any particular skill, with a very small number of connecting pins.

These objects are reached according to the invention in that the leg pairs of each leg member converge upwardly and are rigidly connected together by a head brace, so as to be stackable, and in that arm rests which respectively rest on the head braces are dismountably secured thereto and joined to the back rest via a first pivot pin situated above the level of the arm rests at such a distance from a second pivot pin mounting the back rest to the seating surface the rear end of said arm rest can move beyond the front end of the brace when the back rest is folded down on the seating surface.

Moreover, according to the invention, each arm rest contains a rack system which cooperates with a finger of the conjugate brace, which finger is caught in the arm rest throughout the adjusting stroke by which the back rest inclination can be adjusted, the said arm rest having a lower opening situated at the back of the rack so that the finger can be released when the arm rest is lifted for folding the back rest down.

According to other important characteristics of the invention, the seating surface is integral, preferably by molding, with the two pairs of leg members.

Each arm rest is extended, for the purpose of its articulation on the back rest, by a crook member situated on the inside of the conjugate brace, said crook member moving, during the folding down movement of the back rest, into a front nook of the seating surface and abutting against the bottom of said nook in order to determine the substantially horizontal folding down position of the corresponding arm rest.

The four components of the chair, namely the seating surface and its leg members, the back rest and the arm rests, are in molded plastic material.

The invention will be more readily understood on reading the following description, with reference to the accompanying drawings, in which.

Figure 1:
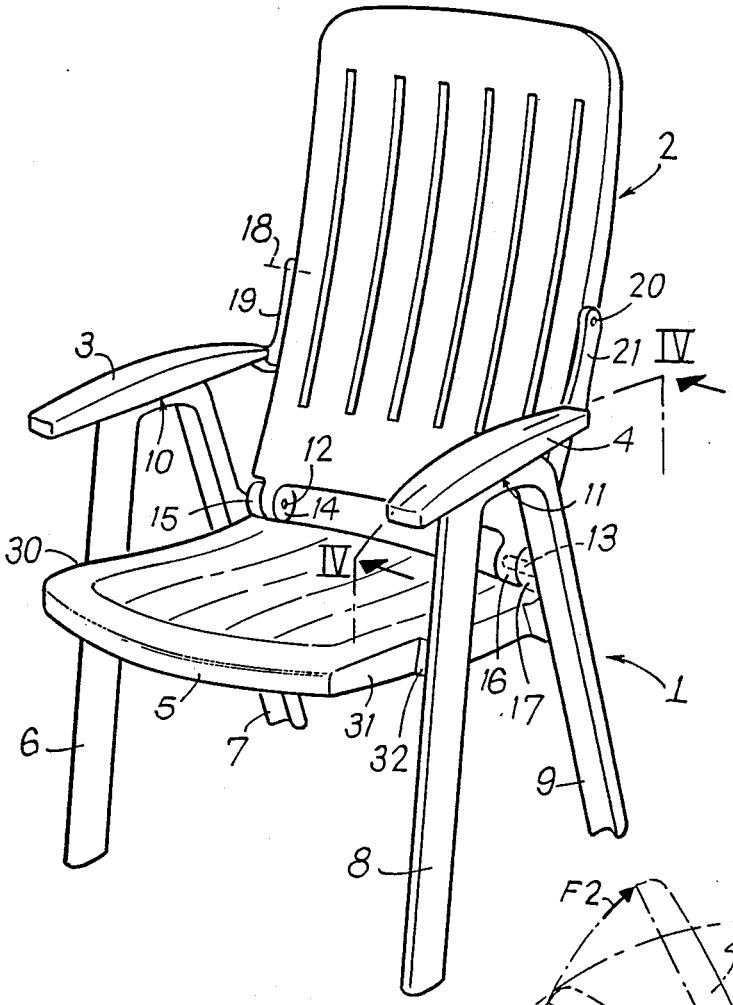
FIG. 1 is a perspective view of the chair according to the invention.

According to the illustrated embodiment, the chair is produced in molded plastic material, in four pieces, constituted by a stool 1, a back rest 2, a right arm rest 3 and a left arm rest 4.

The stool 1 comprises a seating surface 5 molded in one piece with the leg members 6 to 9 and extending on an intermediate level with respect to said leg members. The leg members 6 and 7, situated on the righthand side, converge upwardly and are joined together at their upper part by a head brace 10; similarly, the leg members 8 and 9, situated on the lefthand side, converge upwardly and are joined together at their upper part by a head brace 11.

Thus, the stools 1 of a plurality of chairs, can be stacked, provided however, that the back rests 2 and the arm rests 3, 4 can be folded down over the corresponding seating surfaces 5.

Figure 2:
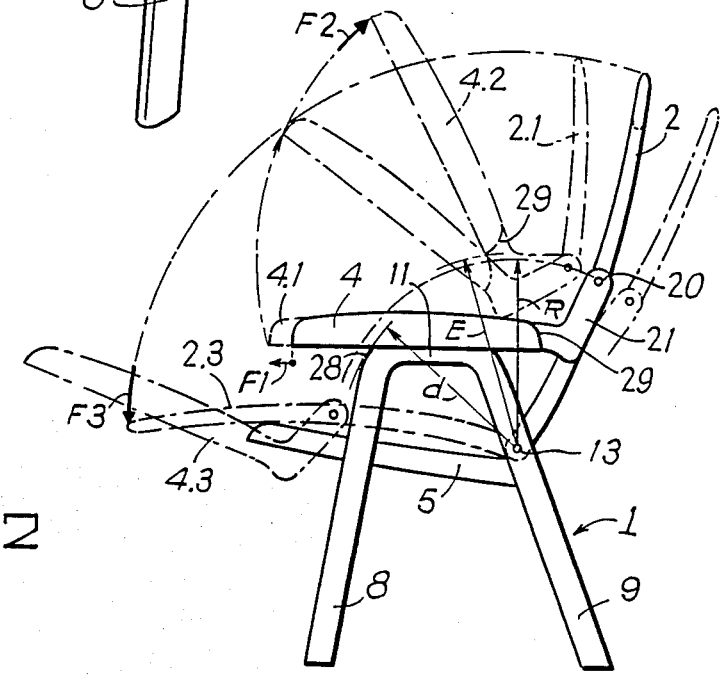
FIG. 2 is a side elevation illustrating the inclination of the back rest and its folding down on the seating surface accompanied by the sliding, lifting up and lowering down of the arm rests.

To this effect, the back rest 2 of the chair illustrated in FIGS. 1 and 2 is articulated at its base relatively to the back of the seating surface 5 by means of pivot pins 12, 13 traversing the lugs 14 and 15, 16 and 17 integral by molding with said back rest and said seating surface. Moreover, the right arm rest 3, which is removably fittable on head brace 10 of the stool, is articulated on back rest 2 by means of a pivot pin 18 traversing a crooked extension 19 of said armrest, and similarly, the left arm rest 4 which is removably fittable on head brace 11 of the stool, is articulated on the back rest 2 by means of a pivot pin 20 traversing a crooked extension 21 of said arm rest. Pivot pins 18 and 20 are in parallel alignment with pivot pins 12 and 13 which are also in line together; moreover, the crooks 19 and 21 make it possible to define the position of pivot pins 18 and 20 high enough above the level of the arm rests. Because of this particular disposition, it is possible, as described in details hereinafter for the lefthand side and with reference to FIG. 2, to fold down the back rest 2 on the seating surface 5 and to cause the arm rests to move over and beyond the head braces 10, 11, the crook members remaining on the inside.

The back rest 2 can be folded down, but furthermore, its inclination can be adjusted.

Figure 4:
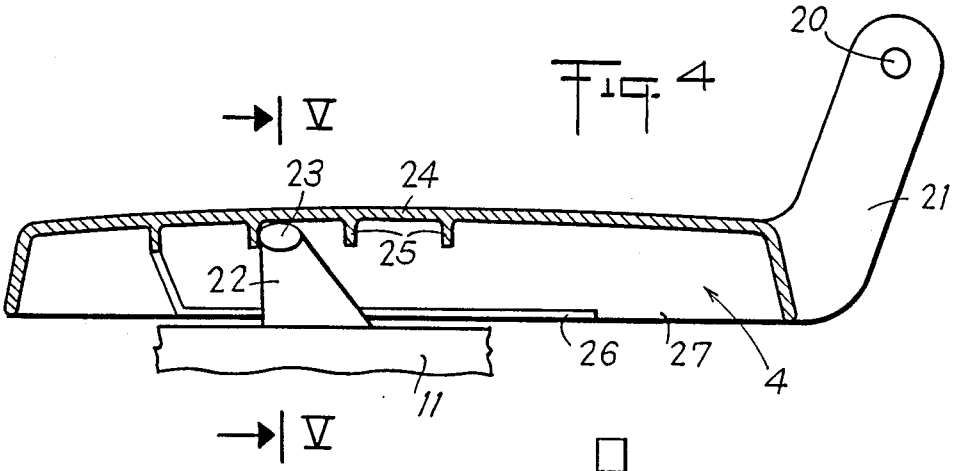
FIG. 4 is a cross-section, on a larger scale, taken along line IV—IV of FIG. 1, to illustrate the back rest inclination rack.
Figure 5:
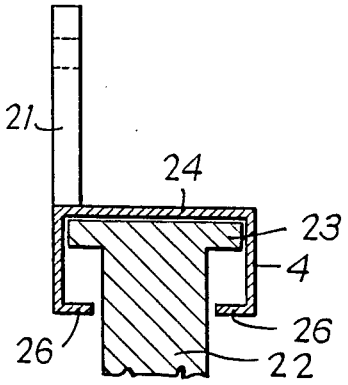
FIG. 5 is a cross-section taken along line V—V of FIG. 4.

To this effect, each one of arm rests 3 and 4 comprises an internal rack system which cooperates selectively with a finger of the conjugate head brace. These means are illustrated, for the left arm rest 4, in FIGS. 4 and 5. A rising lug 22 integral from molding with the head brace 11 of the stool, ends into a finger 23 which projects on both sides. The arm rest 4 has a U-shaped cross-section and fits over the lug 22 and its finger 23; its top part 24 is provided with internally-projecting ribs 25, forming a rack which cooperates with the finger 23; depending on what rib is selected, the arm rest is brought more or less forward and the back rest is more or less inclined; in addition, the side walls of the arm rest are provided with internally projecting lower flanges 25 which prevent the finger 23 from being released; however, an adequate clearance is provided between the ribs 25 and the flanges 26 so that the arm rest can be lifted up and moved in translation when changing the inclination of the back rest. Moreover, the flanges 26 are interrupted at the back of the arm rest, in order to define an opening 27 permitting the complete release of the arm rest 4 from the finger 23, by an upward pivoting movement.

It is important to note, before describing the folding down of the chair for stacking purposes (FIGS. 2 and 5) that the crook members 21 (and 19) extend on the inside of the head braces 10 (and 11) of the stool, but that, on the contrary, the arm rests 4 (and 3) are always plumb with said head braces up to their rear end 29. Also, the distance "R" separating the pivot pins 13 (and 12) connecting the back rest 2 with the seating surface 5 and the pivot pins 20 (and 18) connecting the back rest 2 with the arm rests 4 (and 3) is such, compared with the distance "d" separating said pivot pins 13 (and 12) from the front ends 28 of the head braces 11 (and 10) of the stool, that to each position of the back rest 2 (for example position 2.1) corresponds a raised up position (4.2) of the arm rests 4 (and 3), in which the distance "E" between the pivot pins 13 (and 12) and the rear ends 29 of said arm rests is equal to the distance "d". In other words, the movement of the arm rests over and beyond the head braces when the back rest is folded down, becomes possible due to crook members 21 (and 19) moving pivot pins 20 (and 18) away from pivot pins 13 (and 12).

The procedure to fold up the chair is as illustrated in FIG. 2:

first, it is necessary to move the arm rests 4 (and 3) in translation in the direction of arrow F.1 until they reach the forward position 4.1 in which their opening 27 is situated opposite the fingers 23; to that position 4.1 of the arm rests corresponds the preceding position 2.1 of the back rest, then, it is necessary to raise up the arm rests by causing them to pivot upward in the direction of arrow F.2 about pivot pins 20 (and 18) and at the same time, the back rest 2 must be pivoted forward in the direction of arrow F.3 about pivot pins 13 (and 12), and, having rested the rear ends 29 of the arm rests 4 (and 3) on the head braces 11 (and 10) of the stool, the pivoting of the back rest 2 is continued in the direction of arrow F.3, when the rear ends 29 of the arm rests are moved over and beyond the front ends 28 of the head braces, said arm rests have to be held back. The back rest 2 comes in resting contact on the seating surface 5 (position 2.3) and the crook members 21 (and 19) come to fit in nooks 31 (and 30) of the seating surface (FIG. 1). The substantially horizontal low position 4.3 of the arm rests is obtained by abutment of their crook members against the bottom 32 of said nooks.

Figure 3:
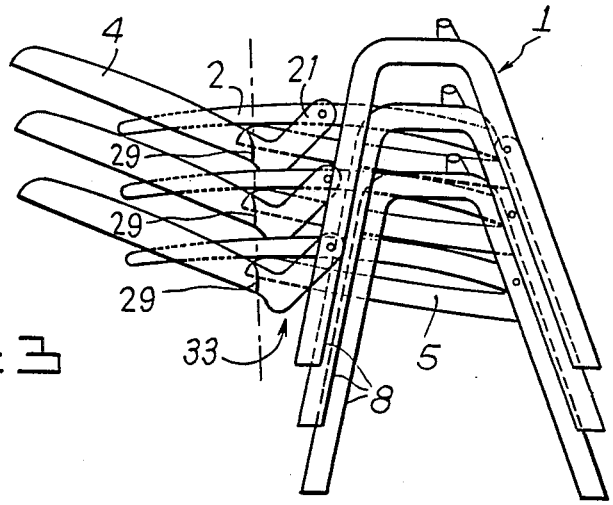
FIG. 3 is a view similar to FIG. 2 showing the stacking of the chairs.

As illustrated in FIG. 3, in said position 4.3 of the arm rests of a plurality of stacked chairs, passages 33 are left between the rear ends 29 of said arm rests and the front leg members 6,8, through which passages the homologous leg members 6, 8 of at least one other chair to be stacked, can be introduced, by being guided therein by the crook members 21 (and 19) of the subjacent chairs.

Obviously, the chair may be constituted by other materials and be assembled differently. For example, each pair of leg members may be made of bent metallic tube secured by screws to a seating surface in wood; the back rest may be a wooden frame lined with a comfortable padding, and this may be the case also for the seating surface; the arm rests may be in wood with the rack system and articulation fitting in metal. But the fact remains that the illustrated example in plastic material is preferred for aesthetic, maintenance, costs and like reasons.

What is claimed is:

1. A chair, comprising:

a seating surface;

two, laterally-spaced leg members for supporting the seating surface, each leg member having a pair of legs, which converge upwardly, and a head brace rigidly joining the pair of legs above the seating surface, whereby to be stackable;

a back rest pivotably mounted at a base thereof on a rear end of the seating surface;

arm rests for respectively resting on the head braces, a rear end of each arm rest being pivotably joined to the back rest above the level of the arm rest when on the head brace and at such a distance from the pivotable mounting of the back rest on the seating surface that the rear end of the arm rest can move beyond an opposite, front end of the head brace when the back rest is pivoted to the seating surface; and securing means for dismountably securing the arm rests respectively to the head braces.

2. The chair of claim 1, wherein each of the securing means copmprises:

a rack system in the arm rest having a lower opening at the end of the rack system nearest the rear end of the arm rest; and a finger on the head brace for catching along the rack system, whereby the inclination of the back rest can be adjusted, and for releasing through the lower opening, whereby the back rest can be pivoted to the seating surface.

3. The chair of claim 1, wherein the seating surface and leg members are integral.

4. The chair of claim 1, wherein opposite sides of an opposite, front end of the seating surface respectively have nooks and wherein the rear ends of the arm rests respectively comprise crook members on the insides of the head braces for butting receipt in the nooks when the back rest is pivoted to the seating surface establishing a substantially horizontal position of the arm rest.

5. The chair of claim 2, wherein opposite sides of an opposite, front end of the seating surface respectively have nooks and wherein the rear ends of the arm rests respectively comprise crook members on the insides of the head braces for butting receipt in the nooks when the back rest is pivoted to the seating surface establishing a substantially horizontal position of the arm rest.

6. The chair of claim 3, wherein opposite sides of an opposite, front end of the seating surface respectively have nooks and wherein the rear ends of the arm rests respectively comprise crook members on the insides of the head braces for butting receipt in the nooks when the back rest is pivoted to the seating surface establishing a substantially horizontal position of the arm rest.

7. The chair of claim 1, wherein the seating surface, leg members, back rest and arm rests are plastic material.

8. The chair of claim 2, wherein the seating surface, leg members, back rest and arm rests are plastic material.

9. The chair of claim 4, wherein the seating surface, leg members, back rest and arm rests are plastic material.

10. The chair of claim 5, wherein the seating surface, leg members, back rest and arm rests are plastic material.

11. The chair of claim 6, wherein the seating surface, leg members, back rest and arm rests are plastic material.

* * * * *